US007555256B2

(12) United States Patent
Ogawa et al.

(10) Patent No.: US 7,555,256 B2
(45) Date of Patent: Jun. 30, 2009

(54) DEVELOPMENT UNIT WITH TONER RECOVERY FOR AN IMAGE FORMING APPARATUS AND PROCESS

(75) Inventors: Takayuki Ogawa, Hoi-gun (JP); Koji Soda, Toyokawa (JP); Noboru Oomoto, Hoi-gun (JP); Yoshitaka Otani, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 295 days.

(21) Appl. No.: 11/163,551

(22) Filed: Oct. 22, 2005

(65) Prior Publication Data

US 2006/0263124 A1 Nov. 23, 2006

(30) Foreign Application Priority Data

May 23, 2005 (JP) ..... 2005-148891

(51) Int. Cl.
*G03G 21/00* (2006.01)

(52) U.S. Cl. ..... 399/359

(58) Field of Classification Search ..... 399/358, 399/359, 360, 29.34, 35, 274, 284
See application file for complete search history.

(56) References Cited

U.S. PATENT DOCUMENTS 3,894,514 A * 7/1975 Caudill et al. ..... 399/93
5,499,090 A * 3/1996 Ito et al. ..... 399/359
5,734,957 A * 3/1998 Ogawa et al. ..... 399/359
5,987,298 A * 11/1999 Muramatsu et al. ..... 399/359
6,112,046 A * 8/2000 Suzuki et al. ..... 399/359
6,577,842 B2 * 6/2003 Akiba et al. ..... 399/359
6,829,461 B2 * 12/2004 Arai et al. ..... 399/253
7,043,190 B2 * 5/2006 Tohata ..... 399/359

FOREIGN PATENT DOCUMENTS

JP 61-223771 10/1986
JP 5-088549 4/1993
JP 06067578 A * 3/1994

(Continued)

OTHER PUBLICATIONS

Notification of Reasons for Refusal issued in corresponding Japanese Patent Application No. 2005-148891, and translation thereof.

*Primary Examiner*—Robert Beatty
(74) *Attorney, Agent, or Firm*—Buchanan Ingersoll & Rooney PC

(57) ABSTRACT

An image forming apparatus includes: an image carrier; a development unit for forming a toner image on the image carrier by supplying a toner contained in a developer reservoir to a latent image formed on the image carrier by means of a developer carrier; a transfer unit for transferring the toner image formed on the image carrier onto a transfer medium; a recovery unit for recovering the toner remaining on the image carrier after image transfer; a return unit for transporting the recover toner recovered by the recovery unit so as to return the recover toner into the developer reservoir of the development unit; and a separator/feeder for separating the toner contained in the developer reservoir from the recover toner thereby exclusively feeding the toner contained in the developer reservoir to the latent image formed on the image carrier by means of the developer carrier.

16 Claims, 2 Drawing Sheets

FOREIGN PATENT DOCUMENTS

| | | | | |
|---|---|---|---|---|
| JP | 07168433 | A | * | 7/1995 |
| JP | 09106235 | A | * | 4/1997 |
| JP | 09127772 | A | * | 5/1997 |
| JP | 10-133533 | | | 5/1998 |
| JP | 10319702 | A | * | 12/1998 |
| JP | 2000258983 | A | * | 9/2000 |
| JP | 2000-284598 | | | 10/2000 |
| JP | 2000293038 | A | * | 10/2000 |
| JP | 2001060043 | A | * | 3/2001 |
| JP | 2002091167 | A | * | 3/2002 |

* cited by examiner

DEVELOPMENT UNIT WITH TONER RECOVERY FOR AN IMAGE FORMING APPARATUS AND PROCESS

RELATED APPLICATION

This application is based on application No. 148891/2005 filed in Japan, the contents of which is hereby incorporated by reference.

BACKGROUND OF THE INVENTION

1. Field of the Invention

The present invention relates to an image forming apparatus such as copiers, printers and facsimiles, and to an image forming process thereof. Particularly, the invention relates to an image forming apparatus including: a development unit for forming a toner image on an image carrier by supplying, by means of a developer carrier, a toner contained in a developer reservoir to a latent image formed on the image carrier; a transfer unit for transferring the toner image formed on the image carrier onto a transfer medium; and a recovery unit for recovering the toner remaining on the image carrier after image transfer.

2. Description of the Related Art

In the conventional image forming apparatuses such as copiers, printers and facsimiles, a development unit adapted to form the toner image in the following manner has been widely used for developing the latent image formed on the image carrier. That is, the toner contained in the developer reservoir is fed to the developer carrier, while the toner thus fed to the developer carrier is regulated by a regulator member. Subsequently, the toner is supplied from the developer carrier to the latent image formed on the image carrier, thereby to form the toner image on the image carrier.

Subsequently, the toner image thus formed on the image carrier is transferred onto the transfer medium by means of the transfer unit. On the other hand, the toner remaining on the image carrier after image transfer is recovered by means of the recovery unit employing a cleaning blade or the like.

In the conventional practice, a recover toner thus recovered by the recovery unit is transported by a transport unit to a waste toner container disposed in the image forming apparatus. Thus, the recover toner is stored in the waste toner container.

Unfortunately, the following problem exists in the above case where the recover toner thus recovered by the recovery unit is stored in the waste toner container disposed in the image forming apparatus. That is, a space to install the waste toner container must be spared in the image forming apparatus, so that the dimensions of the image forming apparatus are increased accordingly. This makes it impossible to meet a recent demand for the downsizing of the image forming apparatus.

Furthermore, another problem is encountered in the above arrangement wherein the recover toner recovered by the recovery unit is stored in the waste toner container. The recover toner is gradually accumulated in the waste toner container, which will become full in the end. If the image forming operation is still further carried on, the recover toner will brim over the waste toner container, so as to be scattered in an interior of the image forming apparatus. Hence, the interior of the image forming apparatus is contaminated with the toner, so that harmful influences are exerted on formed images. This requires a bothersome task to replace the waste toner container at a proper time.

There has been proposed a prior-art apparatus wherein the recover toner thus recovered by the recovery unit is returned by a return unit to the developer reservoir of the development unit so that the recover toner is admixed with the toner contained in the developer reservoir and used again for development.

However, the recover toner is deteriorated as combined with foreign substances such as a filler during the transfer process. In a case where such a recover toner is admixed with the toner contained in the developer reservoir and used again for development, the formed images may be adversely affected.

Still another prior-art apparatus has been proposed wherein a deformable partitioning member is disposed in the developer reservoir of the development unit, such as to partition the developer reservoir into a toner container for containing therein the normal toner and a waste toner container for storing the recover toner. Thus, the recover toner recovered by the recovery unit in the aforementioned manner is returned into the waste toner container by means of the return unit, whereby the recover toner is prevented from being used again for development (Japanese Unexamined Patent Publication No. H05-088549).

However, it is a cumbersome task to mount the deformable partitioning member in the developer reservoir. In addition, an increased cost results.

SUMMARY OF THE INVENTION

The invention is directed to solution to the aforementioned problems encountered by the image forming apparatus including: the development unit for forming the toner image on the image carrier by supplying, by means of the developer carrier, the toner contained in the developer reservoir to the latent image formed on the image carrier; the transfer unit for transferring the toner image formed on the image carrier onto the transfer medium; and the recovery unit for recovering the toner remaining on the image carrier after image transfer.

In the above image forming apparatus which employs the return unit for returning the recover toner recovered by the recovery unit to the developer reservoir of the development unit as described above, an object of the invention is to prevent the recover toner from being reused for development without providing the deformable partitioning member in the developer reservoir for partitioning the developer reservoir into the toner container for containing the normal toner therein and the waste toner container for containing the recover toner therein.

An image forming apparatus according to the invention comprises: an image carrier; a development unit including a developer carrier, a developer reservoir and a toner, and operating to supply the toner contained in the developer reservoir to the image carrier by means of the developer carrier, thereby developing a latent image, formed on the image carrier, into a toner image; a transfer unit for transferring the toner image on the image carrier onto a transfer medium; a recovery unit for recovering the toner remaining on the image carrier after image transfer; a return unit for transporting a recover toner recovered by the recovery unit to return the recover toner into the developer reservoir; and a separator/feeder for separating the toner contained in the developer reservoir from the recover toner thereby exclusively feeding the toner to the developer carrier.

The image forming apparatus according to the invention is constituted such that the toner remaining on the image carrier after image transfer is recovered by the recovery unit and that the recover toner thus recovered is transported by the return unit so as to be returned into the developer reservoir of the development unit. This negates the need for providing the waste toner container in the image forming apparatus, so that the image forming apparatus may be downsized.

The image forming apparatus according to the invention is constituted such that the above separator/feeder separates the toner contained in the developer reservoir from the above recover toner returned into the developer reservoir and feeds the toner to the developer carrier, and that the developer carrier supplies the toner to the latent image formed on the image carrier. Thus is eliminated the problem that the recover toner is re-used for development, adversely affecting the formed images. In addition, the need to provide the deformable partitioning member in the developer reservoir is negated.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

An image forming apparatus according to an embodiment of the invention will be specifically described with reference to the accompanying drawings. It is noted that the image forming apparatus according to the invention is not limited to those illustrated by the following embodiments and modifications or changes may be made thereto, as required, so long as such modifications or changes do not deviate from the scope of the invention.

Figure 1:
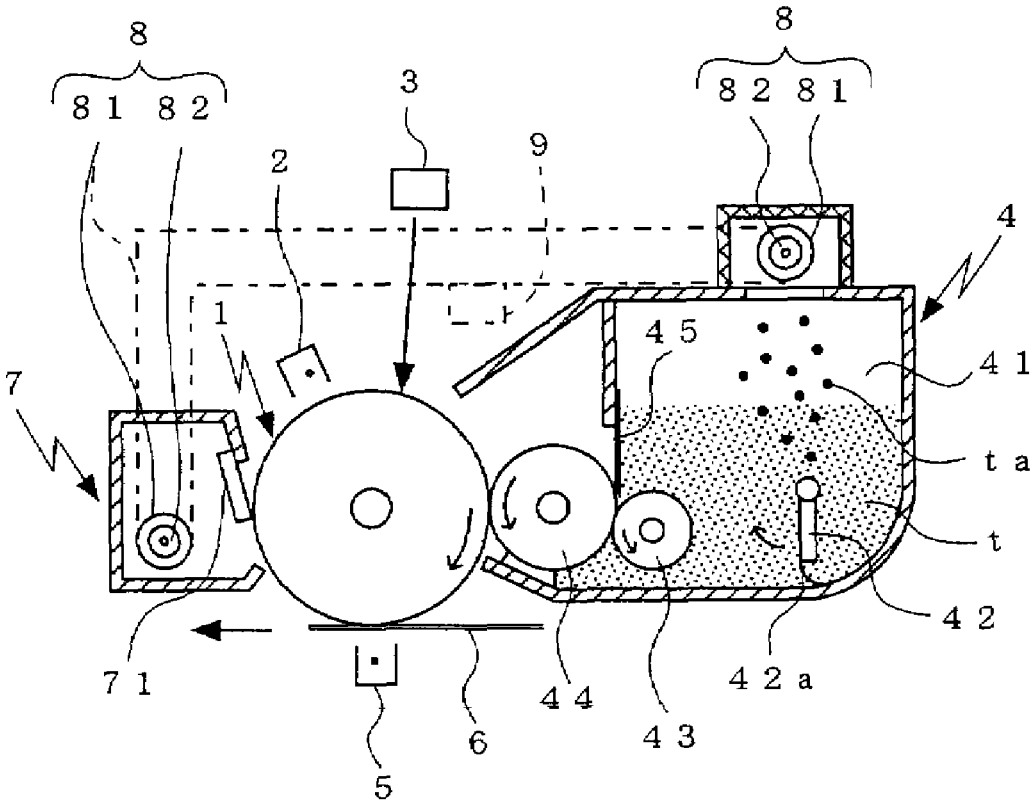
FIG. 1 is a schematic diagram illustrating an image forming apparatus according to one embodiment of the invention.

The image forming apparatus according to the embodiment is of a one-component development system. As shown in FIG. 1, the image forming apparatus employs a drum-shaped photosensitive member as an image carrier 1. The image carrier 1 is rotated, while a charger unit 2 electrically charges a surface of the image carrier so rotated. Subsequently, an exposure unit 3 irradiates light on the charged surface of the image carrier 1 according to image information, thereby forming an electrostatic latent image on the surface of the image carrier 1.

A toner t is supplied from a development unit 4 to the surface of the image carrier 1 with the electrostatic latent image formed thereon, thereby to form, on the image carrier 1, a toner image corresponding to the electrostatic latent image.

In the development unit 4, an agitating member 42 disposed in a developer reservoir 41 is rotated, the developer reservoir containing the toner t therein. Thus, the rotated agitating member 42 agitates the toner t contained in the developer reservoir 41, while advancing the toner t toward a rotating feed roller 43 by means of a feeding vane 42*a* attached to a distal end of the agitating member 42. The rotating feed roller 43, in turn, feeds the toner t to a rotating developer carrier 44. At some point of the course of transporting the toner t thus fed to the rotating developer carrier 44 to a development region opposite the image carrier 1, a regulator member 45 is pressed against a surface of the developer carrier 44. The regulator member 45 triboelectrically charges the toner t fed to the surface of the developer carrier 44 and also regulates the amount of toner t carried by the developer carrier 44 to the image carrier 1. Then, the toner t thus regulated in amount and triboelectrically charged is delivered by the developer carrier 44 to the development region opposite the image carrier 1. The toner t is supplied to an area of the electrostatic latent image formed on the image carrier 1, so as to form the toner image on the surface of the image carrier 1.

The toner image thus formed on the image carrier 1 is transported to place opposite a transfer unit 5. In the meantime, a transfer medium 6 such as a transfer sheet is delivered to place between the image carrier 1 and the transfer unit 5 so as to transfer the toner image formed on the image carrier 1 onto the transfer medium 6. The transfer medium 6 with the toner image transferred thereto is delivered to a fixing unit (not shown) so as to fix the transferred toner image to the transfer medium 6.

The toner t remaining on the surface of the image carrier 1 after image transfer is recovered by a recovery unit 7 as follows. A cleaning blade 71 disposed at the recovery unit 7 is abutted against the surface of the image carrier 1, thereby removing and recovering the toner t remaining on the image carrier 1 after image transfer from the surface of the image carrier 1.

A recover toner ta so recovered from the surface of the image carrier 1 by means of the recovery unit 7 is transported by means of a return unit 8 so as to be returned into the aforesaid developer reservoir 41 of the development unit 4.

Figure 2:
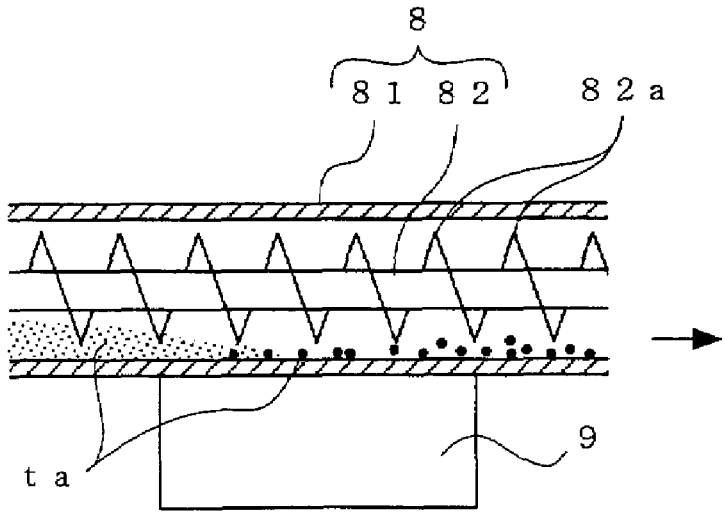
FIG. 2 is a schematic diagram illustrating how the image forming apparatus according to the above embodiment aggregates a recover toner into toner aggregates in the course of returning the recover toner into a developer reservoir of a development unit.

In this embodiment, the aforesaid return unit 8 returns the recover toner ta into the developer reservoir 41 of the development unit 4 in the following manner. As shown in FIG. 1 and FIG. 2, a transport member 82 equipped with a transport screw 82*a* is extended through a return pipe 81 interconnecting the recovery unit 7 and the developer reservoir 41 of the development unit 4. The transport member 82 is rotated to transport the recover toner ta from the recovery unit 7 to the development unit 4.

The transportation of the recover toner ta by the return unit 8 may be performed in synchronism with the recovery operation. Otherwise, the transportation of the recover toner may be performed at a point of time that a certain amount of recover toner ta is accumulated in the recovery unit 7. The following arrangement may be made in the above case where the recover toner ta is transported at the point of time that the certain amount of recover toner is accumulated in the recovery unit 7. The recovery unit 7 may be provided with a sensor (not shown) for detecting the amount of recover toner ta. When a detected value given by the sensor exceeds a predetermined value, the recover toner ta may be transported. Alternatively, the recover toner ta may be transported at a point of time that a predetermined number of images are formed after the start of operation of the image forming apparatus, or that the operation time of the development unit 4 reaches a predetermined value.

As shown in FIG. 2, a heating element 9 as an aggregator 9 is disposed at some midpoint of the transport path to transport the recover toner ta from the recovery unit 7 to the development unit 4. The heating element heatingly aggregates the recover toner ta into toner aggregates, while the recover toner ta is transported by means of the transport member 82. The recover toner ta thus aggregated is returned into the developer reservoir 41 through the aforesaid return pipe 81. It is noted here that the size in which the recover toner ta is aggregated may be adjusted by changing the heating temperature of the aforesaid heating element 9 or the speed at which the recover toner ta is transported by the transport member 82. In a case where a toner t having a mean particle size on the order of 7 μm is used, for example, the recover toner ta from this toner t is so aggregated as to have a mean particle size on the order of 100 μm.

It is preferred in this case that the heating temperature of the heating element 9 is set to not less than a glass transition point of a resin component of the toner and that the temperature of the recover toner ta being transported is set to not less than the glass transition point of the above resin component but not more than a melting point thereof. The above glass transition point and melting point are values determined based on JIS K7121.

On the other hand, the aforesaid return unit 8 may preferably employ the transport screw 82*a* coated with a fluorine-containing resin. In this case, the heated recover toner ta is prevented from being fused to the transport screw 82*a*. Incidentally, a silicone resin may also be used in place of the above fluorine-containing resin.

Figure 3:
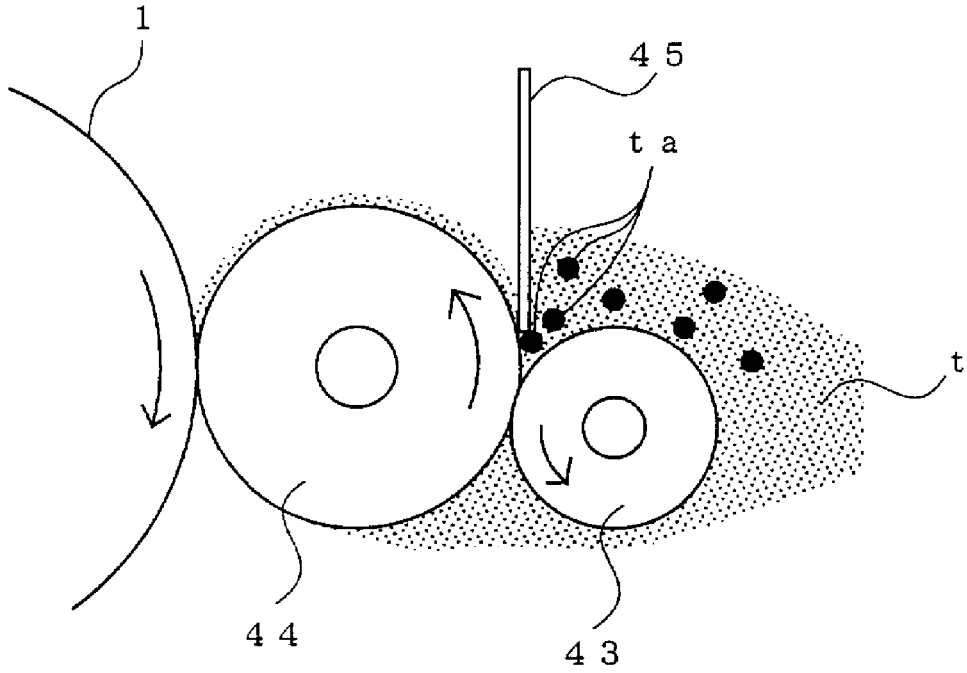
FIG. 3 is a schematic diagram illustrating a state of the image forming apparatus according to the above embodiment wherein the recover toner increased in particle size due to aggregation is separated from a surface of a developer carrier as regulated by a regulator member.

When the recover toner ta thus aggregated is returned into the developer reservoir 41, the recover toner ta thus aggregated is also advanced toward the feeding roller along with the toner t contained in the developer reservoir 41 by means of the feeding vane 42*a* attached to the distal end of the agitating member 42 rotated in the aforementioned manner. Thus, the toners are fed to the developer carrier 44 by means of the feeding roller 43. As shown in FIG. 3, however, the recover toner ta increased in particle size as aggregated in the aforementioned manner is regulated by the regulator member 45 pressed against the surface of the developer carrier 44, so as to be separated from the surface of the developer carrier 44. This prevents the recover toner ta from being delivered by the developer carrier 44 to the development region opposite the image carrier 1 and used for development. Thus, the recover toner ta is prevented from adversely affecting the image to be formed.

Further, when the heating element 9 is provided as the aggregator 9 such that the recover toner ta may be heatedly aggregated as mentioned above, the resultant recover toner ta aggregates are prevented from being cracked when subjected to the regulation by the regulator member 45. Hence, the recover toner ta is assuredly separated from the developer carrier 44. It is thus ensured that the recover toner ta is positively prevented from being re-used for development.

If the image forming operation is repeated in this manner, the toner t contained in the developer reservoir 41 is consumed and gradually decreased in quantity, whereas the aggregated recover toner ta in the developer reservoir 41 is gradually increased in quantity.

In such a case where the toner t contained in the developer reservoir 41 is depleted whereas the aggregated recover toner ta is accumulated in the developer reservoir 41, such a condition is detected such that the above development unit 4 with the aggregated recover toner ta accumulated therein may be replaced by a new one. In such an arrangement, the recover toner ta is returned into the developer reservoir 41 of the development unit 4 and accumulated therein as described above. This negates the need for providing a separate waste toner container in the developer reservoir 41 for storing the recover toner ta, as practiced in the prior art. Accordingly, it is possible to downsize the image forming apparatus. Furthermore, the problem related to over-accumulated recover toner ta brimming over the waste toner container is obviated.

Figure 4:
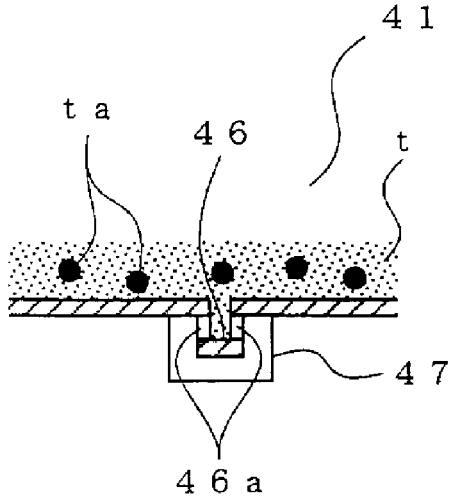
FIG. 4 is a schematic diagram illustrating how the consumption of the toner contained in the developer reservoir is detected in the image forming apparatus according to the above embodiment.

The depletion of the toner t contained in the developer reservoir 41 may be detected as follows. As shown in FIG. 4, for example, a toner detection groove 46 so configured as not to allow the invasion of the aggregated recover toner ta may be provided at a lower part of a lateral side of the developer reservoir 41, and may be partially formed with a transparent window 46*a*, through which an optical sensor 47 may detect the toner t in the groove 46 so as to determine the depletion of the toner t contained in the developer reservoir 41. However, the method to determine the depletion of the toner t contained in the developer reservoir 41 is not limited to the above. For instance, the amount of toner t on the surface of the developer carrier 44 after regulated by the regulator member 45 or the amount of toner t in the toner image formed on the image carrier 1 may be detected by means of a known sensor. If the detected value is less than a predetermined value, then it may be determined that the toner t contained in the developer reservoir 41 is depleted.

According to the foregoing embodiment, the heating element 9 is used as the aggregator 9 for aggregating the recover toner ta into toner aggregates. That is, the recover toner ta is heated by the heating element 9 so as to be aggregated into the toner aggregates. However, the aggregator 9 is not limited to the heating element 9. Although illustration is omitted, it is also possible, for example, to spray liquid to the recover toner ta being transported as described above thereby aggregating the recover toner ta into toner aggregates, or to mix the recover toner ta with adhesive particles thereby aggregating the recover toner ta into toner aggregates.

Although the present invention has been fully described by way of examples, it is to be noted that various changes and modifications will be apparent to those skilled in the art.

Therefore, unless otherwise such changes and modifications depart from the scope of the invention, they should be construed as being included therein.

What is claimed is:

1. An image forming apparatus comprising:

an image carrier;

a development unit including a developer carrier, a developer reservoir and a toner and operating to supply the toner contained in the developer reservoir to the image carrier by means of the developer carrier, thereby developing a latent image, formed on the image carrier, into a toner image;

a transfer unit for transferring the toner image on the image carrier onto a transfer medium;

a recovery unit for recovering the toner remaining on the image carrier after image transfer;

a return unit for transporting a recover toner recovered by the recovery unit to return the recover toner into the developer reservoir;

an aggregator for aggregating the recover toner into developer aggregates: and a separator/feeder for separating the toner contained in the developer reservoir from the recover toner thereby exclusively feeding the toner to the developer carrier, wherein the separator/feeder comprises a regulator member pressed against a surface of the developer carrier for removing the recover toner from the developer carrier, and the regulator member is provided on a side of the developer carrier that is opposite the image carrier.

2. An image forming apparatus of claim 1, wherein the aggregator is a heating element for heatingly aggregating the recover toner into developer aggregates.

3. An image forming apparatus of claim 1, further comprising:

a detector for detecting the amount of recover toner so recovered; and a controller directing the return unit to transport the recover toner when a detected value given by the detector exceeds a predetermined value.

4. An image forming apparatus of claim 1, further comprising a controller for counting the number of formed images from the start of operation of the development unit and directing the return unit to transport the recover toner when the number of formed images reaches a predetermined number.

5. An image forming apparatus of claim 1, further comprising a controller for counting operation time from the start of operation of the development unit and directing the return unit to transport the recover toner when the operation time reaches a predetermined value.

6. An image forming apparatus of claim 1, wherein the return unit includes a transport screw, which is coated with a fluorine-containing resin or a silicone resin.

7. An image forming apparatus of claim 1, further comprising a detector for detecting the depletion of the toner contained in the developer reservoir.

8. An image forming process comprising:

forming an electrostatic latent image on an image carrier;

forming a toner image by developing the electrostatic latent image on the image carrier by means of a development unit including a developer reservoir containing a toner therein;

transferring the toner image onto a recording medium;

recovering the toner remaining on the image carrier after image transfer;

transporting the recover toner thus recovered to the developer reservoir;

aggregating the recover toner into developer aggregates; and separating an unused toner contained in the developer reservoir from the recover toner transported into the developer reservoir, and supplying the unused toner to the electrostatic latent image on the image carrier, wherein the separating the unused toner comprises removing the recover toner from the developer carrier from a side of the developer carrier that is opposite the image carrier by a regulator member pressed against a surface of the developer carrier.

9. An image forming process of claim 8, wherein aggregating the recover toner into the developer aggregates is accomplished by heating the recover toner for aggregation.

10. An image forming process of claim 9, wherein when the recover toner is heated, a heating temperature is set to not less than a glass transition point of a resin component of the toner and not more than a melting point of the resin component.

11. An image forming process of claim 8, further comprising:

detecting an amount of recover toner recovered from the image carrier after image transfer; and transporting the recover toner to the developer reservoir when the amount of recover toner exceeds a predetermined value.

12. An image forming process of claim 8, further comprising counting the number of formed images from the start of operation of the development unit and transporting the recover toner to the developer reservoir when the number of formed images reaches a predetermined value.

13. An image forming process of claim 8, further comprising counting operation time from the start of operation of the development unit and transporting the recover toner to the developer reservoir when the operation time reaches a predetermined value.

14. An image forming process of claim 8, wherein the transporting the recover toner to the developer reservoir uses a transport screw coated with a fluorine-containing resin or a silicone resin for transporting the recover toner to the developer reservoir.

15. An image forming process of claim 8, wherein the regulator member comprises a regulator blade.

16. An image forming apparatus of claim 1, wherein the regulator member comprises a regulator blade.

* * * * *